US005499481A

United States Patent [19]

Targetti

[11] Patent Number: 5,499,481

[45] Date of Patent: Mar. 19, 1996

[54] SECTIONAL NETWORK STRUCTURE FOR LIGHTING

[76] Inventor: Giampalo Targetti, Via Barbacane No. 29, 50133 Firenze, Italy

[21] Appl. No.: 203,388

[22] Filed: Mar. 1, 1994

[30] Foreign Application Priority Data

Mar. 5, 1993 [IT] Italy ..... FI93A0037

[51] Int. Cl.[6] ..... E04H 12/10

[52] U.S. Cl. ..... 52/654.1; 52/650.3; 52/653.1; 52/655.1; 52/693; 52/694; 211/13; 211/189; 362/388; 362/404

[58] Field of Search ..... 52/654.1, 650.3, 52/690, 693, 694, 648.1, 653.1, 655.1; 362/147, 148, 388, 204, 404; 211/13, 189

[56] References Cited

U.S. PATENT DOCUMENTS

| | | | |
|---|---|---|---|
| 2,660,102 | 2/1950 | Tarof | 52/694 |
| 3,030,670 | 4/1962 | Bigelow | 52/650.3 |
| 3,049,196 | 8/1964 | Attwood | 52/650.3 X |
| 3,600,869 | 8/1971 | Petroff | 52/654.1 X |
| 4,324,083 | 4/1982 | Johnson, Jr. | 52/654.1 X |
| 4,381,636 | 5/1983 | Sapp | 52/650.3 |
| 4,862,336 | 8/1989 | Richardson et al. | 362/404 X |
| 4,866,583 | 9/1989 | Targetti | 362/404 |

*Primary Examiner*—Carl D. Friedman
*Assistant Examiner*—Christopher Todd Kent
*Attorney, Agent, or Firm*—Hopgood, Calimafde, Kalil & Judlowe

[57] ABSTRACT

The structure comprises, in combination, lattice elements (1) with successive sides (1A) inclined in opposite directions; longitudinal connecting pieces (1B) and partial longitudinal connecting pieces (1C) for the joining of successive lattice clients (1) in alignment with each other; links (3) for connection between longitudinal connecting pieces (1B, 1C) of adjacent lattice elements (1) which have been brought together; components for mechanical connection (5, 7) between successive lattice elements (1) and/or components for mechanical and electrical connection (24, 26) between successive lattice elements; adaptors (61, 71) which may be fitted to said longitudinal connecting pieces (1B, 1C) for lighting or consumer units to be combined with the reticular structure.

8 Claims, 11 Drawing Sheets

Fig. 2
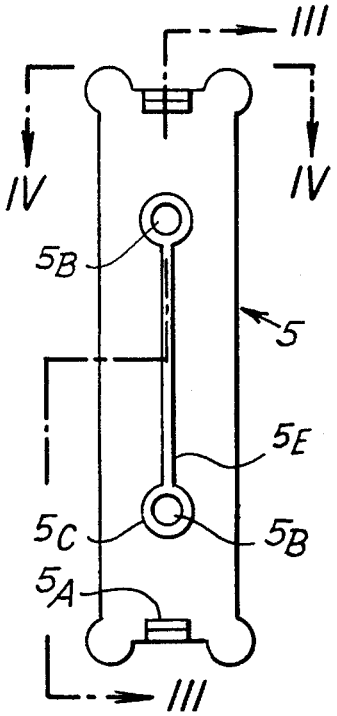
Fig. 3
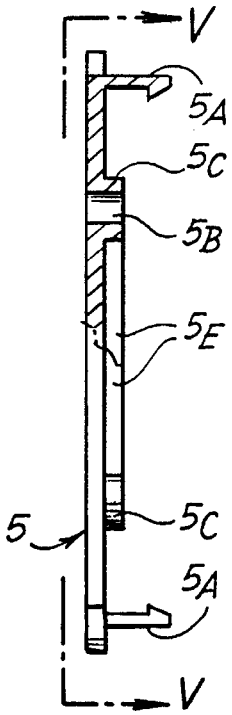
Fig. 5
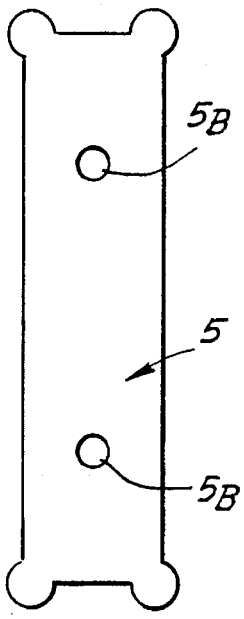
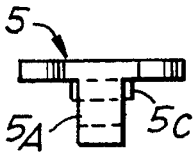
Fig. 4
Fig. 6
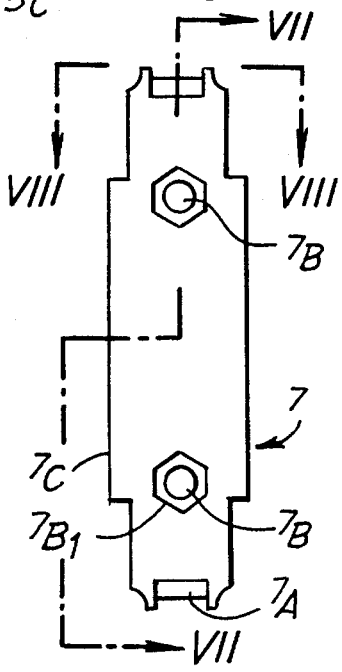
Fig. 7
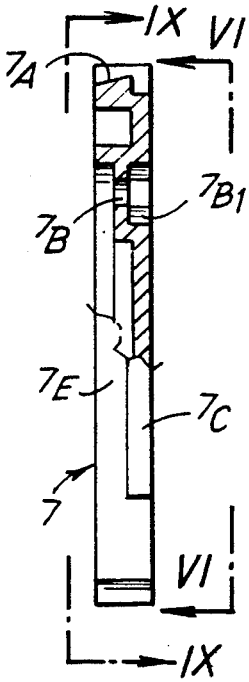
Fig. 9
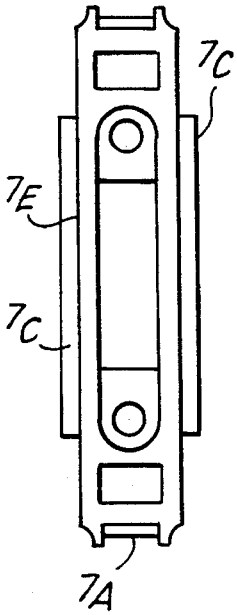
Fig. 8
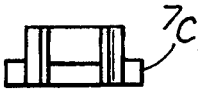

Fig. 10
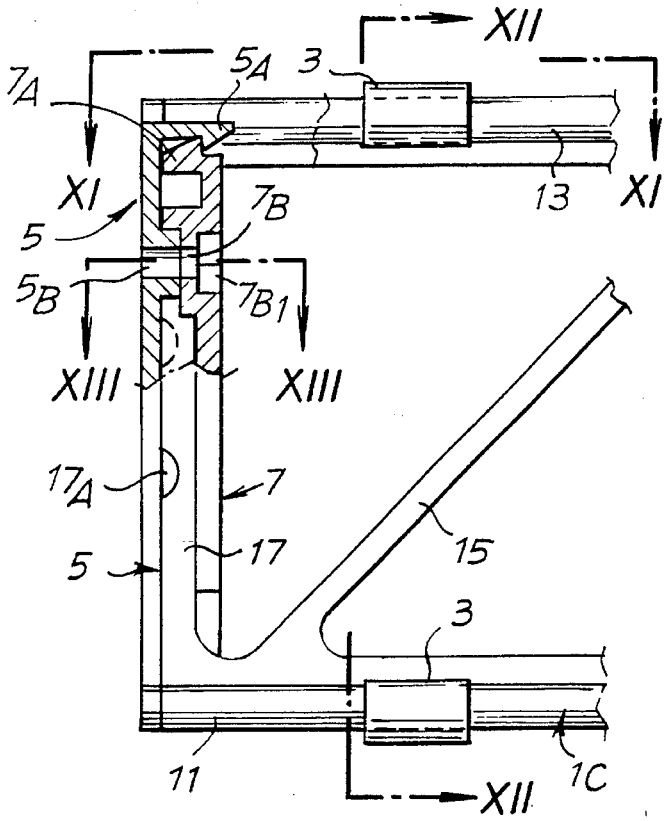
Fig. 12
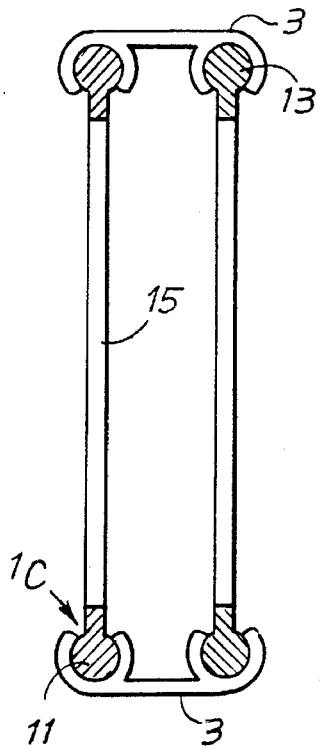
Fig. 11
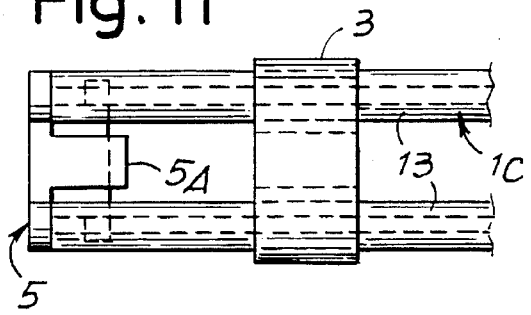
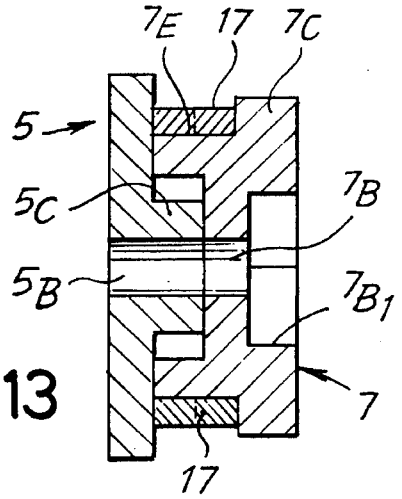
Fig. 13

Fig.19 Fig.20 Fig.22 Fig.24
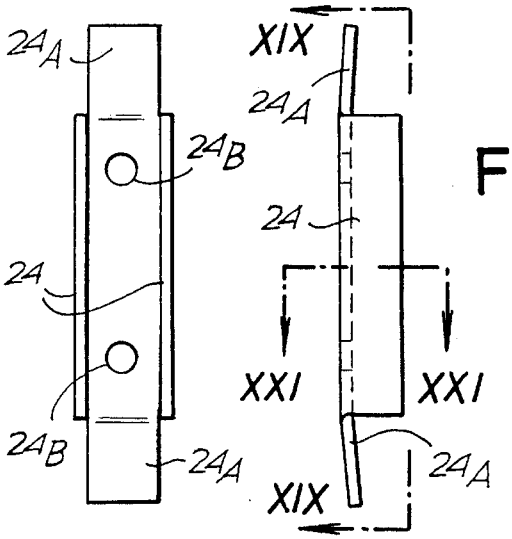
Fig.21
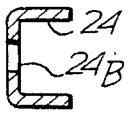
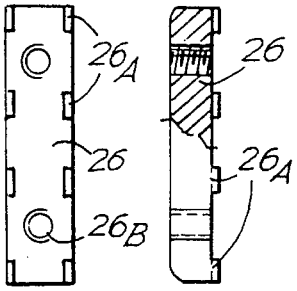
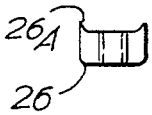
Fig.23
Fig.27
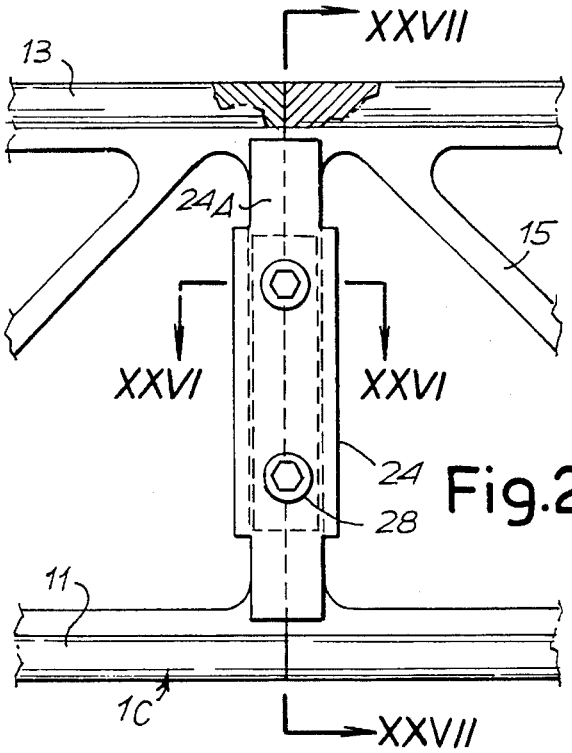
Fig.25
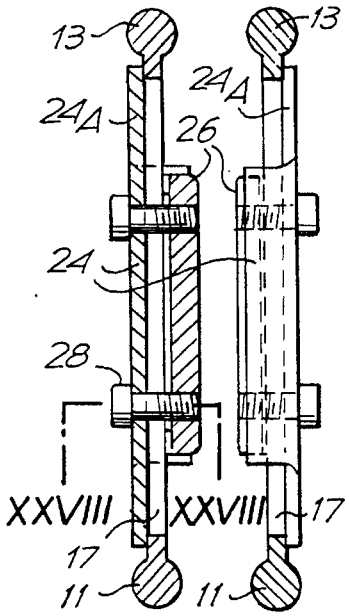
Fig.28
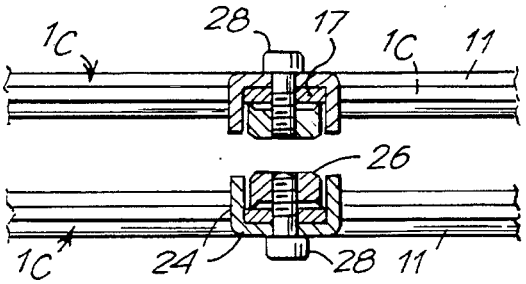
Fig.26
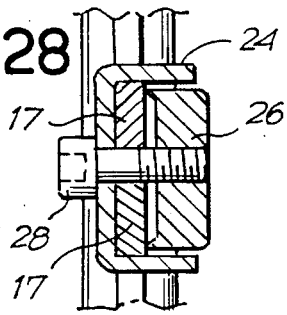

Fig. 29
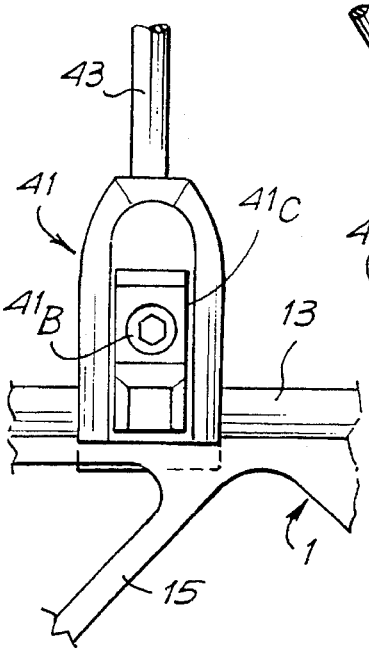
Fig. 30
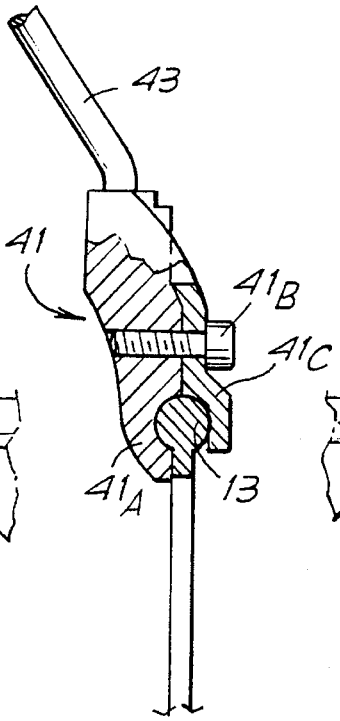
Fig. 31
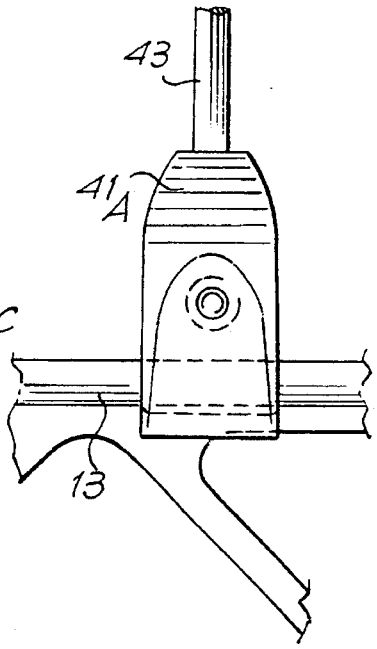
Fig 33
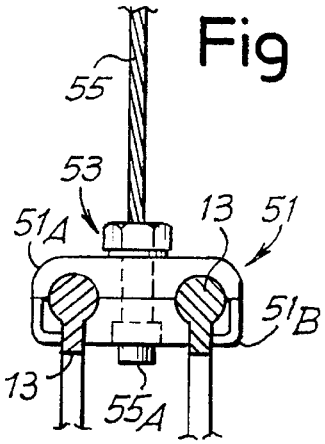
Fig. 32
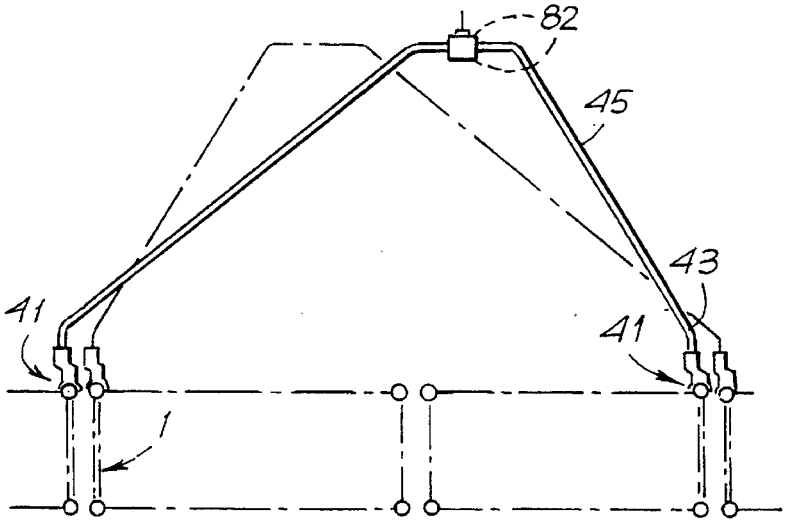
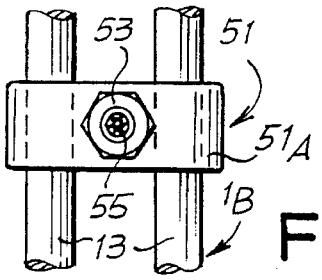
Fig. 34

Fig. 38
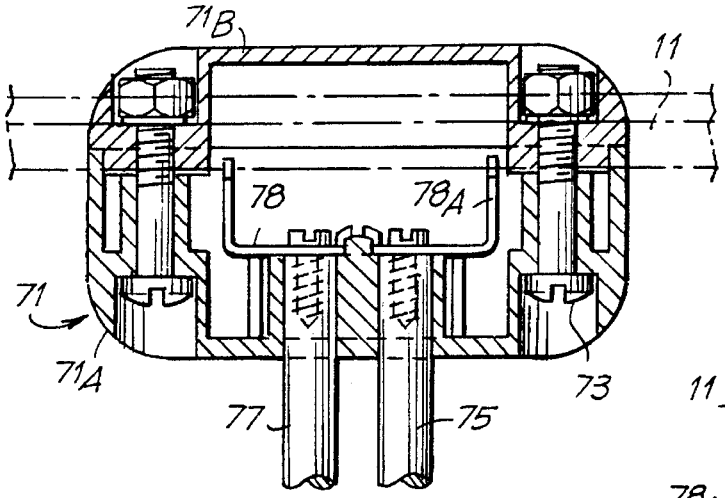
Fig. 40
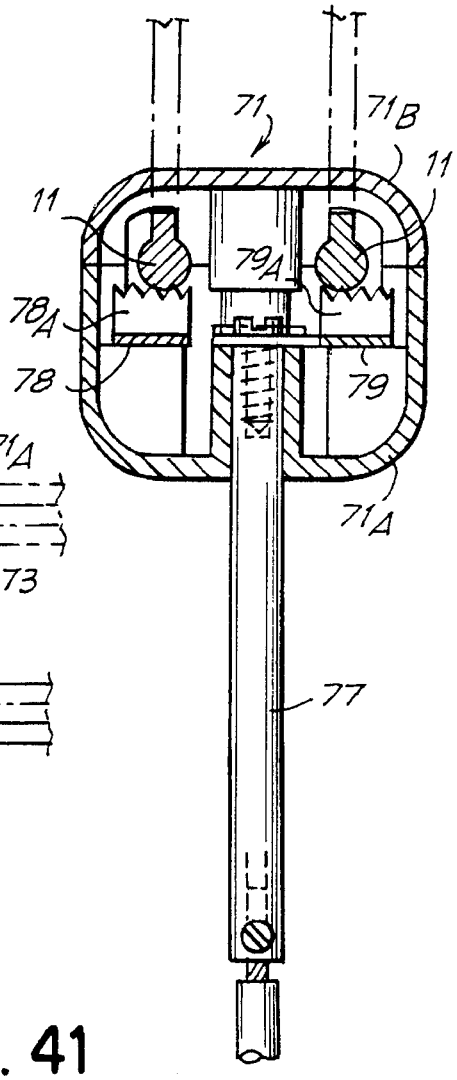
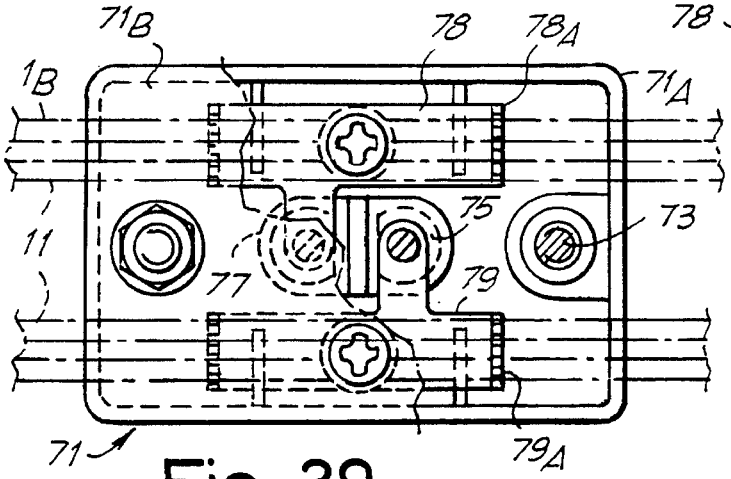
Fig. 39
Fig. 41
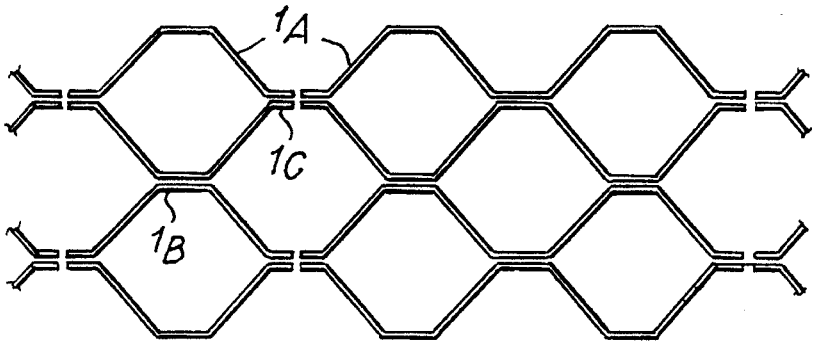

SECTIONAL NETWORK STRUCTURE FOR LIGHTING

DESCRIPTION

The invention relates to a reticular structure, namely a sectional network structure of a type specially designed to be light, easily and rapidly assembled, flexible in its application and functional in its adaptability to a variety of requirements. These and other objects and advantages will be made clear by the following text.

Substantially, the structure in question comprises, in combination, lattice elements with successive sides inclined in opposite directions; longitudinal connecting pieces and partial longitudinal terminal connecting pieces for the joining of successive lattice elements in alignment with each other; links for snap connection between longitudinal connecting pieces of adjacent lattice elements which have been brought together; components for mechanical connection and alternatively components for mechanical and electrical connection between successive lattice elements; adaptors which may be fitted to said longitudinal connecting pieces for lighting or consumer units to be combined with the reticular structure.

The connecting links are electrically insulating; at least some of the connecting components are components for mechanical and electrical connection, so that the successive lattice elements of a line form a low-voltage current conductor to be combined with another conductor formed by a contiguous line of successive butted lattice elements, for the supply of the lighting units. To achieve this, the adaptors have current take-off type clamps, for the supply of the corresponding lighting or consumer units.

Jaw-type clamps which can be locked onto the lattice elements, for the electrical power supply or for transverse electrical connections, may be fixed to the structure.

The components for mechanical connection may comprise a body and a plate used as terminals for terminal cross-pieces for transverse connection between the ends of upper and lower sections of the adjacent lattice elements; said body and said plate being joinable by, in particular, a snap fit. One body and one plate may form a trim terminal when fitted to the abutting ends of contiguous lattice elements, said components having nut and bolt means passing through them for a mechanical joint.

The components for mechanical and electrical connection may comprise a U section capable of containing the adjoining terminal cross-pieces of successive lattice elements, and a plate which can be tightened with a screw against said section.

Other details are specified in dependent claims at the end of the present description.

A fuller understanding of the invention will be obtained from the description and the attached drawing, which shows a non-restrictive practical embodiment of the invention. In the drawing, FIG. 1 is a perspective view of two adjacent lattice elements with some components;

FIGS. 2, 3, 4 and 5 show one of the two mechanical connection components in a view through II—II in FIG. 3, a view along IV—IV in FIG. 2, and in a view along V—V in in a view and partial section along III—III in FIG. 2, in FIG. 3;

FIGS. 6, 7, 8 and 9 show the other mechanical connection component in a view along VI—VI in FIG. 7, in a view and partial section along VII—VII in FIG. 6, in views along VIII—VIII in FIG. 6 and IX—IX in FIG. 7;

FIGS. 10, 11, 12 and 13 show the ends of a lattice element complete with the two components shown in FIGS. 2–5 and 6–9 acting as terminals, and views and sections along XI–XI, XII–XII and XIII–XIII in FIG. 10;

FIGS. 19, 20 and 21 show one of the two components for mechanical and electrical connection between two successive lattice clients in two views along XIX—XIX in FIG. 20 and XX–XX in FIG. 19 and in section along XXI—XXI in FIG. 20;

FIGS. 22, 23 and 24 are three views of the other of the two components for mechanical and electrical connection;

FIGS. 25, 26, 27 and 28 show the components for mechanical and electrical connection of FIGS. 19–24 fitted to two butted lattice elements in section along XXVI–XXVI and XXVII–XXVII in FIG. 25 and in a local enlarged section along XXVIII–XXVIII in FIG. 27 respectively;

FIGS. 29, 30 and 31 are two views and a partial section of a jaw-type clamp for electrical and optionally mechanical connection;

FIG. 32 shows a mode of application of these clamps;

FIGS. 33 and 34 show a clamp for suspension and connection between adjacent lattice elements;

FIGS. 35, 36, 37 and 38, 39, 40 are views and sections of two types of adaptors which may be fitted to the structure according to the invention;

FIG. 41 is a diagram of a structure foxing conductors;

Figure 42:
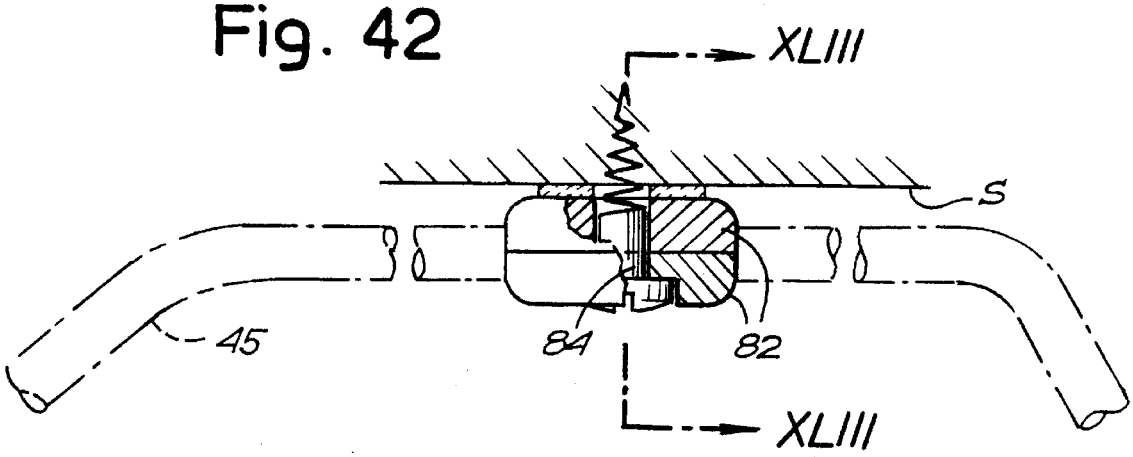
Figure 43:
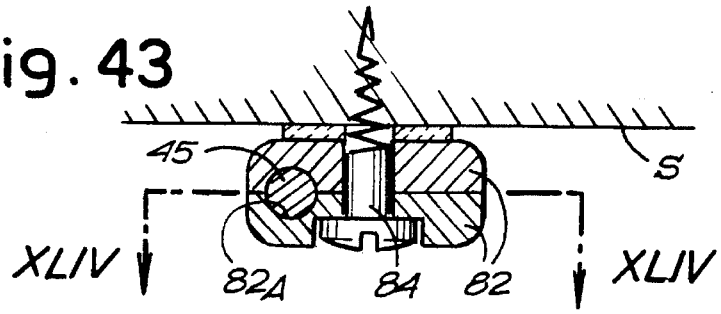
Figure 44:
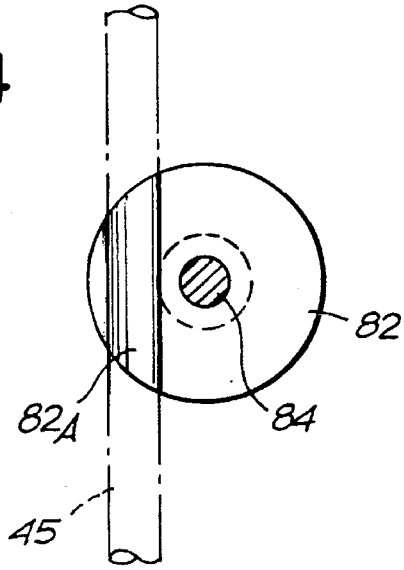
Figure 45:
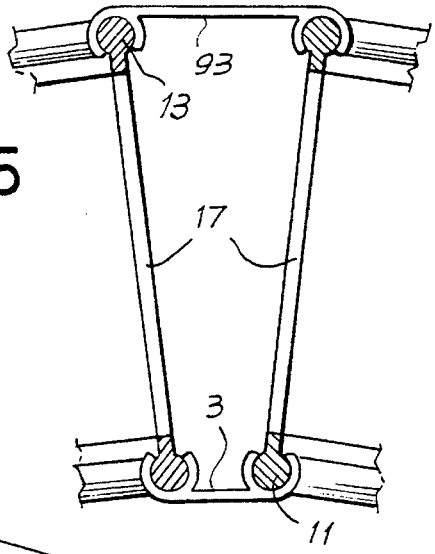
Figure 46:
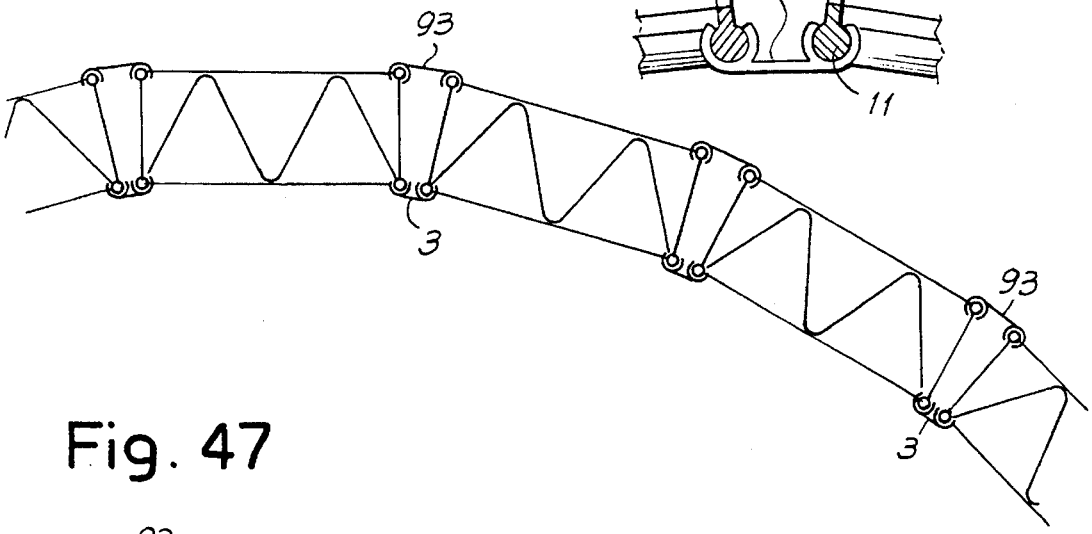
Figure 47:
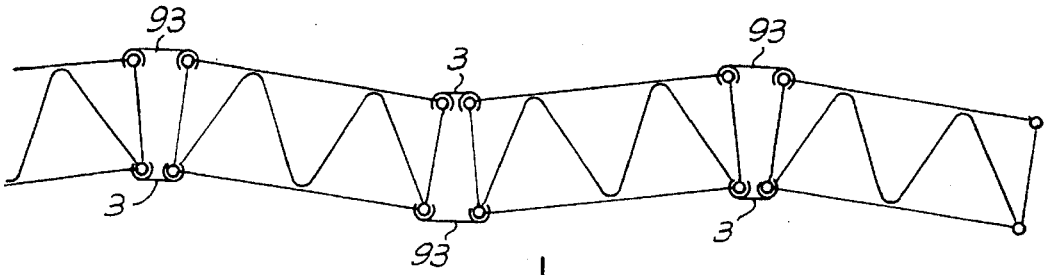
Figure 49:
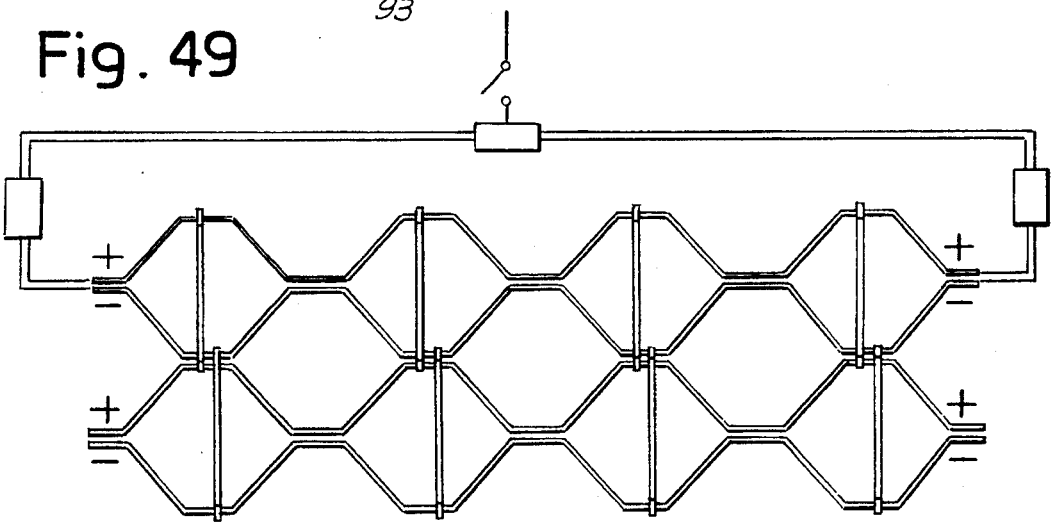
Figure 48:
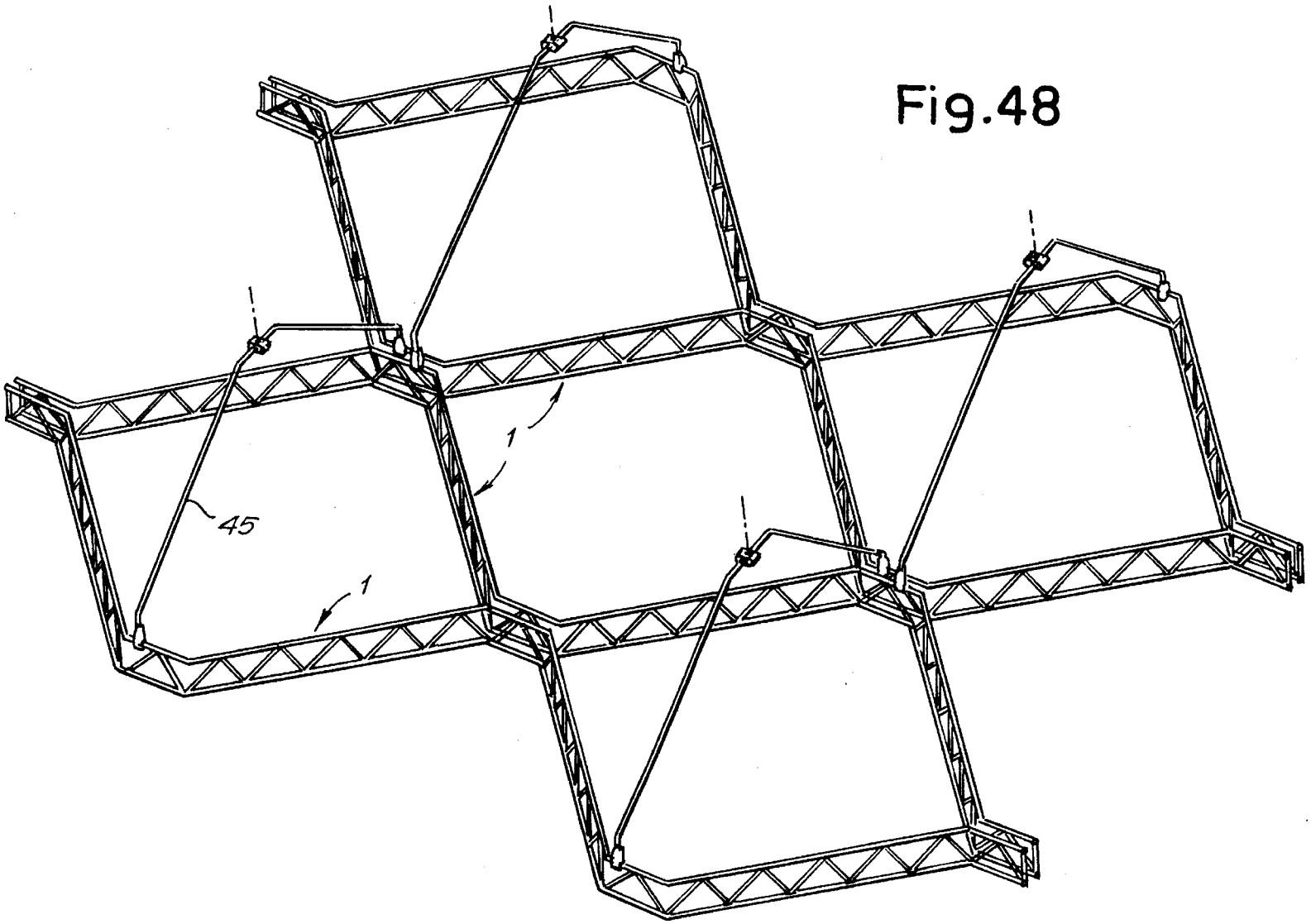

FIGS. 42, 43, and 44 show a system of fitting using members shown in FIG. 32;

FIGS. 45, 46 and 47 show a variant of the connection shown in FIG. 12 and structures which may be formed with this; and FIGS. 48 and 49 are diagrams of electrical connections for the power supply.

Figure 1:
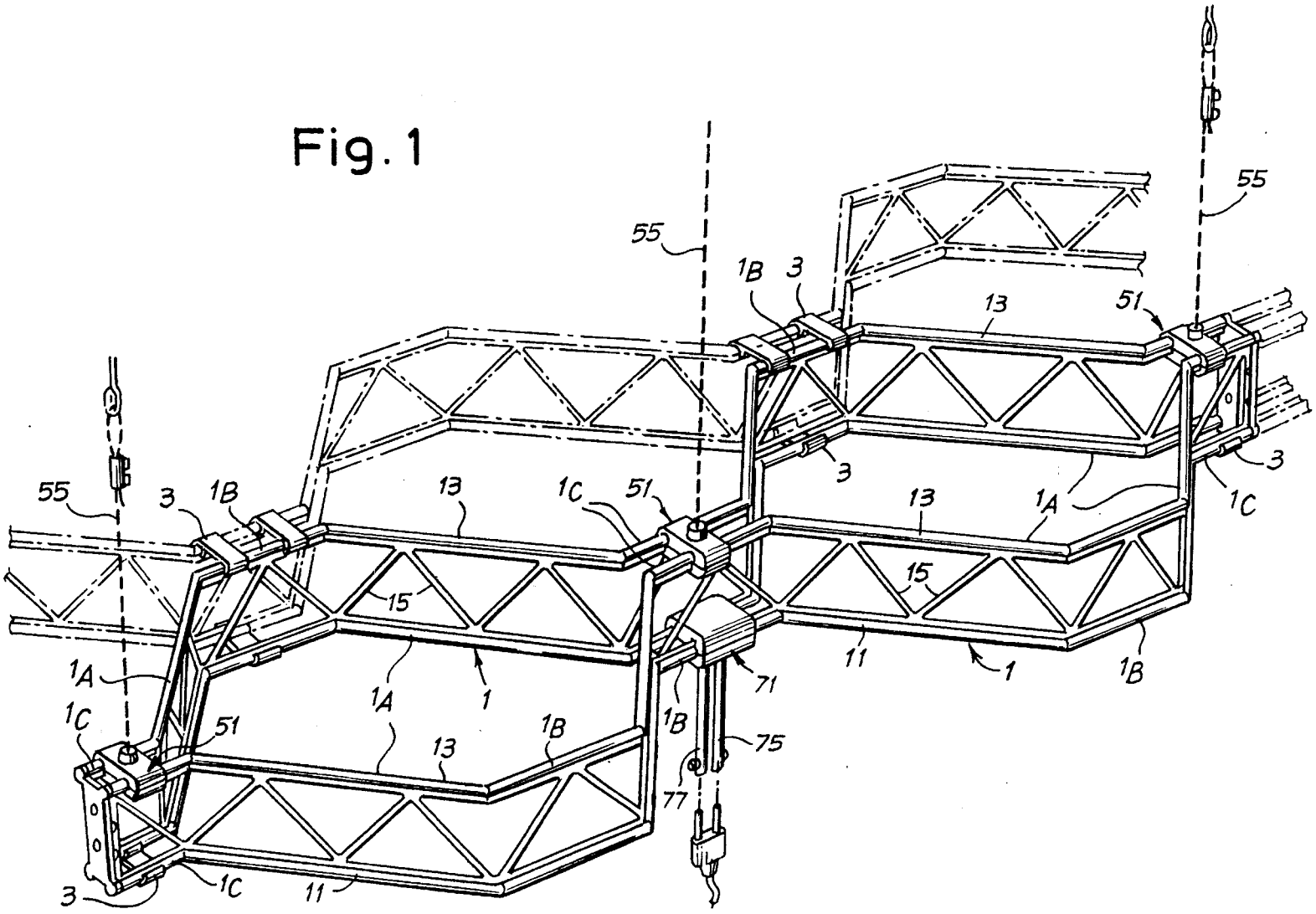
Figure 14:
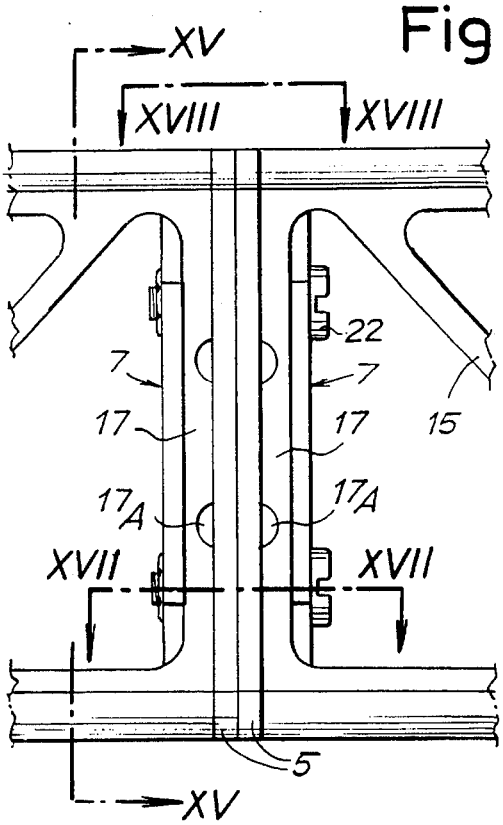
FIGS. 14, 15, 16, 17 and 18 show the mechanical connection components of FIGS. 2–9 for the connection of two butted lattice elements, in an external view along XIV–XIV in FIG. 15, in section along XV–XV in FIG. 14, in section along the line XVI–XVI in FIG. 15, in section along XVII–XVII in FIG. 16, and in a view along XVIII–XVIII in FIG. 14 respectively.
Figure 15:
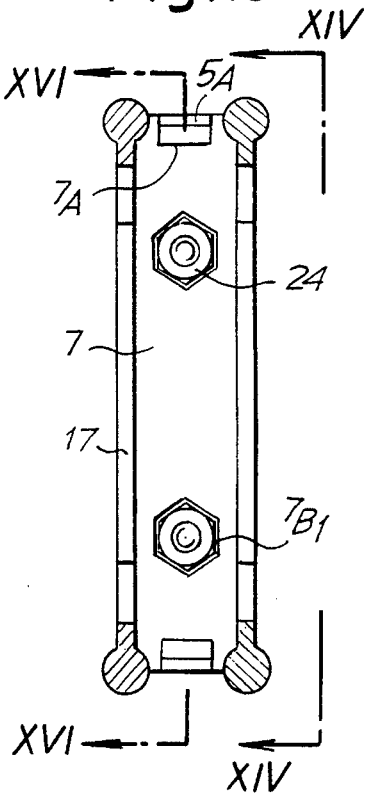
Figure 18:
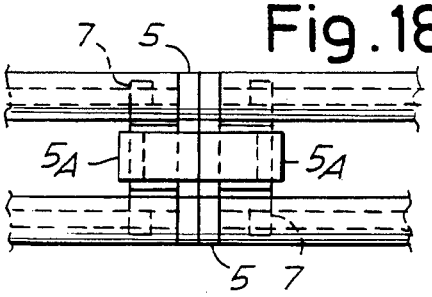
Figure 16:
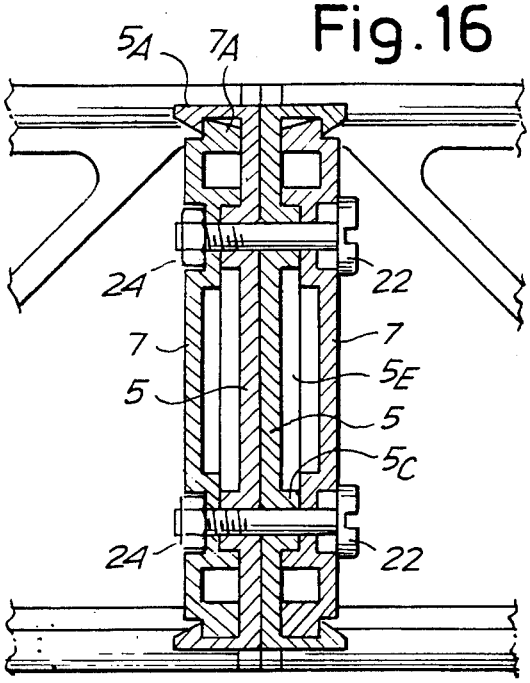
Figure 17:
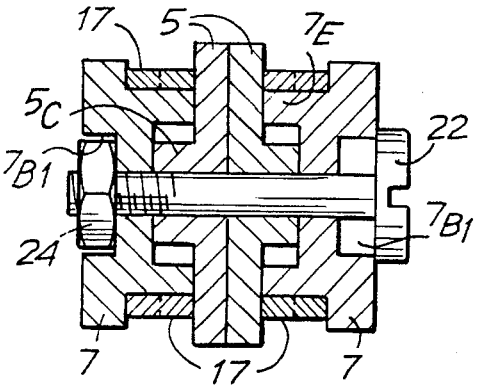

In the illustrations in the attached drawing, and in particular in FIG. 1, the number 1 indicates two lattice elements which lie adjacent to each other in FIG. 1, each of which has sides 1A inclined in opposite directions, longitudinal connecting pieces 1B, and partial longitudinal end connecting pieces 1C. The connecting pieces 1B and 1C of each lattice element are aligned with each other. In a structure of more than one element, the two partial longitudinal end connecting pieces 1C are aligned with each other and butted together, and the longitudinal connecting pieces 1B and the partial longitudinal connecting pieces 1C are all parallel to each other.

Each lattice element is made up of two longitudinal sections, a lower one 11 and an upper one 13, connected by inclined cross-pieces 15. The sections 11, 13 and the lattice connections 15 have a relatively lightweight structure and these sections 11 and 13 in particular have a principal portion of circular cross-section, as shown in particular in FIG. 12, for example. Terminal cross-pieces 17 extend orthogonally with respect to the sections 11 and 13 and connect their ends together.

Two lattice elements, as illustrated for example in FIG. 1, are brought together to form a reticular structure; the disposition of the two lattice elements is such that the partial longitudinal connecting pieces 1C and the longitudinal connecting pieces 1B are adjacent and close to each other. The mechanical connection between the adjacent lattice elements 1 is made with connecting links 3, made of insulating material with limited elasticity; each link 3 has two profiles, spaced apart, for snap fitting to the areas 11 and 13 of the sections 1. In this way, by distributing the links 3 suitably along the longitudinal connecting pieces 1B and 1C, a mechanical connection is made between the adjacent lattice elements 1.

Lattice elements 1 which are contiguous to each other can be joined with either of two types of mechanical connection components or mechanical and electrical connection components, according to whether the lattice which is constructed is to act only as a mechanical or also as an electrical connection for the supply of lighting units or other electrical consumer units, which will be mounted and distributed suitably on the lattice structure formed with the lattice elements 1. Components for mechanical connection only are also usable as terminals for a line of components 1.

FIGS. 2–5 and 6–9 respectively show the two mechanical connection components which are capable of engaging with each other and which are designed either to form—when used in pairs—the terminals for the reticular structure, or to be joined to another two contiguous mechanical connection components for a mechanical connection between lattice elements 1 butted together. One mechanical connection component is indicated by 5 and is illustrated in FIGS. 2–5, and the other mechanical connection component is indicated by 7 and is illustrated in FIGS. 6–9. The component 5 is formed as a rectangular elongated plate with projections of circular profile at the corners and with two appendages with elastic hooks 5A projecting centrally from the upper and lower short sides of the plate; in an intermediate position there are provided holes 5B which on one side of the plate are surrounded by collars 5C, the two collars being connectable by an intermediate longitudinal rib 5E. The other mechanical connection component 7 is also formed as a plate with a substantially rectangular overall profile and has, along its smaller sides, two toothed profiles 7A designed to interact with the elastic hook appendages 5A, and, in an intermediate position, holes 7B which correspond to the holes 5B and are surrounded by hexagonal sockets 5B1 for nuts designed for joining by the method stated below; along their longitudinal sides, the plates of the components 7 have longitudinal ribs 7C projecting slightly at the sides and longitudinal edges 7E which, together with the ribs 7C, form steps which can form a retaining device by the method stated below.

The two components 5 and 7 are mounted at the ends of partial longitudinal connecting pieces 1C of adjacent lattice elements and engage with the terminal cross-pieces 17 of the sections 11, 13 of the lattice elements 1. The elements 5 and 7 are inserted between the cross-pieces 17 of the two adjacent lattice elements, the cross-pieces 17 being engaged (see in particular FIGS. 13 and 17) between the ribs 7C, the edges 7E and the outer longitudinal edges of the plates 5, while the elastic hook appendages 5A are hooked onto the toothed profiles 7A of the components 7. In the joining of the two components 5 and 7, the holes 5B and 7B come into alignment. The joining of the components 5 and 7 at the ends of the lattice elements is clearly visible in FIGS. 10, 11, 13, 14, 16 and 17. It will be noted that, to form terminals as shown in FIGS. 10–13, the components 5 and 7 are joined to the two cross-pieces 17 and the plate of the component 5 forms the terminal with the projections of circular profile at the corners, which correspond to the sections 11 and 13 of the two lattice elements. To form a mechanical connection between pairs of butted adjacent lattice elements, as shown in FIGS. 14–18, use is made of bolts 22 which pass through the aligned holes 5B and 7B of the four components 7, 5, 5, 7 and which engage in nuts 24 held in the housings 7B1 around the holes 7B, the mechanical connection may be made with great ease by placing the nuts 24 in the housings 7B1 and inserting the bolts 22 into the aligned holes 7B, 5B, 5B, 7B; the material of the two components 5 and 7 around the holes 5B, 7B is in contact owing to the presence of the collars 5C. In this way, the mechanical connection is made by joining pairs of components 5 and 7, and the joint is made mechanically with the bolts 22 and the nuts 24.

FIGS. 19–28 illustrate the two components of a mechanical and electrical connection and their mode of operation for the mechanical and electrical connection of two lattice elements 1 butted against each other with the two partial longitudinal end connecting pieces 1C and the corresponding terminal cross-pieces 17. In this case, the terminal cross-pieces 17 and the sections 11 and 13 must be connected electrically as well as mechanically at the butted ends, to enable current to pass between contiguous lattice elements 1. This is done with the mechanical and electrical connection components shown in FIGS. 19–28. One of these consists of a U-section metal component 24 with two longitudinal tabs 24A projecting from the intermediate connecting part of the U section and slightly inclined with respect to the section 24; the intermediate connecting part of the U section 24 has a pair of holes 24B. The other mechanical and electrical connection component consists of a metal bar 26 which has small teeth 26A which project from one of its faces and may be made by mechanical deformation of the material of the bar 26; the bar 26 also has threaded holes 26B with the same spacing as the holes 24B; the bar 26 can be inserted in the U section 24. A component 24 can be fitted onto the pair of cross-pieces 17 which become adjacent with the butting of the two ends of the sections 11, 13, 15 of the partial longitudinal connecting pieces 1C in alignment with each other; the bars 26 are placed against the adjacent cross-pieces 17, and the two components 24 and 26 are secured with screws 28, which are easily turned from the outside, since the components 24 are external. When the two screws 28 are tightened to join the components 24, 26, the tabs 24A are forced onto the sections 11 and 13 and provide a mechanical and electrical joint. The electrical joint between the two sections, and in particular between the two adjacent cross-pieces 17, is also provided by the penetration of the teeth 26A of the bars 26, which are forced into and cut through any paint on the cross-pieces 17 to provide metallic contact. To permit the passage of the screws 28, each of the cross-pieces 17 has small approximately semi-circular depressions, indicated by 17A, along its outer edge (see in particular FIGS. 10 and 14). Two pairs of mechanical and electrical connection components 24, 26 are used for the connection of the butted ends 1C of two pairs of lattice elements, so that connections are made between contiguous lattice elements with the security of a connection which is electrical as well as mechanical, while the sections of the two lines of lattice elements are kept spaced apart by the insulating links 3 described previously.

With the electrical and mechanical connections made with the components 24, 26, the aligned and butted lattice elements are made into longitudinal electrical conductors as seen in FIG. 41, so that pairs of electrical conductors formed in this way may be alternated to supply the electrical consumer units such as lighting units or others, which are fitted on the adjacent connecting pieces 1B or 1C of the overall reticular structure formed by a plurality of lattice elements 1. If different areas of supply are to be provided within the overall lattice structure, electrical insulation is obtained by using, instead of the mechanical and electrical connection components formed by the elements 24 and 26, the components 5 and 7 for mechanical connection only, as described above, which provide a mechanical connection but not an electrical connection. It is thus possible to obtain selective power supplies in different areas, controllable through corresponding electric switches.

The overall structure is completed with other accessories and other components which are described below with particular reference to FIG. 29 and the following figures FIGS. 29–31 show a jaw-type clamp indicated in a general way by 41, having a body 41A forming a cradle, particularly for the upper section 13 of a lattice element 1; a screw 41D can be used to secure against this body a securing element 41C capable of engaging the section 13 and forcing it against the cradle formed by the part 41A. At least one of the two components of the clamp 41 has substantially pointed appendages capable of penetrating into the paint or other surface coating of the section 13 to provide electrical contact with it. The jaw-type clamp 41 may be integral with a bar or rod conductor 43, used for an electrical connection, for example with a link 45 (see FIG. 32) which provides an electrical connection between jaw-type clamps 41 of two conductors formed by two non-contiguous lines of lattice elements connected together mechanically and electrically by the systems shown in FIGS. 19–24. The bars 41 or other conductors, of the stranded type for example, may be used for connection to an electrical power distribution installation. The jaw-type clamps 41may be fitted at any point of the upper sections 13 of the reticular structure.

FIGS. 33 and 34 show a clamp 51 which may preferably be made of a material which is insulating but mechanically robust (with a shape similar to that of the links 3) with two parts 51A and 51B which may be joined together by a securing bolt means 53; this last may have running through it a suspension cable 55 which can be fixed with a suitable end piece 55A under the clamp 51. This clamp can be fitted on the sections 13 where the longitudinal connecting pieces 1B or 1C are adjacent, at suitable points to provide mechanical support of the overall lattice structure formed in the way described previously. FIG. 1 shows some of the cables 55 suitably distributed.

Figure 35:
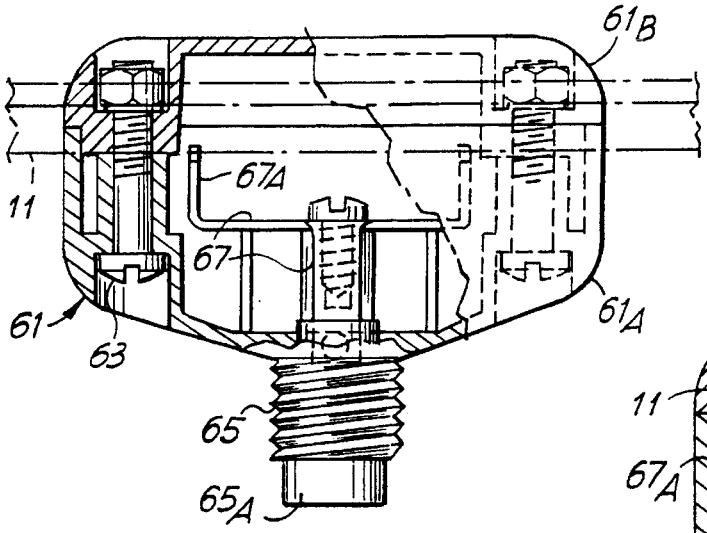
Figure 36:
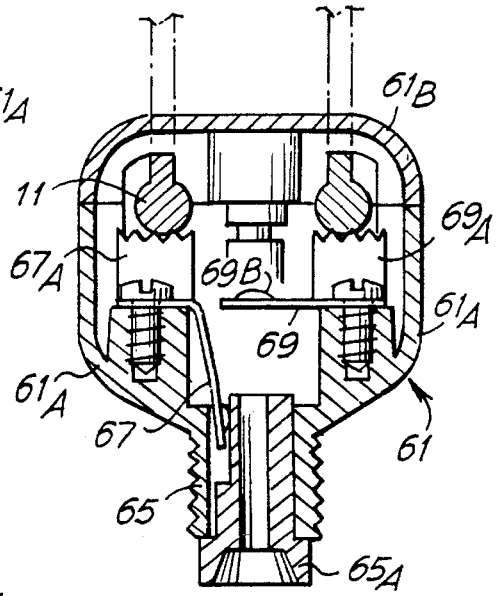
Figure 37:
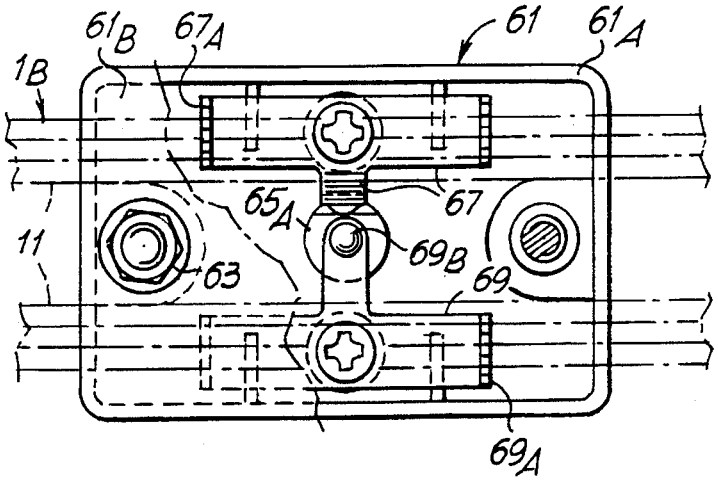

FIGS. 35–37 show an adaptor, in other words a suspension and current take-off unit for an item of electrical equipment, particularly a lighting unit, which may be fitted along a pair of adjacent connecting pieces 1B or 1C between two lattice elements I which are adjacent and are connected in the way described above; in this it is possible to take current from lattice elements which are adjacent and electrically insulated to form power supply conductors. FIGS. 35–37 show an adaptor for take-off through coaxial conductors which also form a suspension system. A casing 61 formed by two parts 61A and 61B may be fitted by means of screws 63 onto the two adjacent sections 11 of two longitudinal connecting pieces 1B (or 1C), to form a current take-off and suspension adaptor for an item of electrical equipment. Under the part **61*a* of the casing 61 there is disposed a connector 65 with a metal tube 65A which is connected internally to a plate 67 having toothed right-angled projections 67A which, when the two parts 61A, 61B of the casing 61 are closed on the section 11, are forced into and cut through any paint to provide an electrical contact. A second plate 69 with toothed right-angled projections 69A (similar to the projections 67A) is engaged in the part 61A of the casing to carry with an appendage 69B a contact coaxial with and above the metal tube 65A; this tube is pierced to permit the passage of a rod covered in insulating material to form one of the take-off conductors with the appendage 69B, while the tube 65A** itself forms part of the other conductor.

FIGS. 38–40 show an adaptor similar to the preceding one, with a body 71 in two parts, 71A, 71B, joinable with screw means 73 for locking onto two adjacent sections 11; the difference from the preceding solution is that this adaptor has two columns 75, 77, each forming a means of mechanical attachment and a conductor for an item of electrical equipment suspended from said body 71; the bars 75 and 77 are electrically integral with plates 78 and 79 respectively, each of which has its ends folded at a right angle 78A, 79A to press against the sections 11 and provide electrical contact even through any paint which may be present; the two plates 78, 79 have two appendages, out of alignment, for electrical and mechanical engagement with the two columns 75 and 77.

In both the solutions for adaptors in FIGS. 35–40, the plates 67, 69 and 78, 79 are made to be fixed by suitable screw means on thickened areas of the parts 61A and 71A respectively.

The adaptors such as 61 and 71 may be fitted on longitudinal connecting pieces 1B or on partial connecting pieces 1C, their presence being compatible with the presence of links such as 3 for spacing, which can alternatively be provided directly by the sockets formed by the joining of the bodies 61A, 61B and 71A, 71B of the adaptors, which are engaged with the two lower sections 11 of said adjacent longitudinal connecting pieces.

FIGS. 42–47, with reference also to FIG. 32, show a system for the application or suspension of a structure using the links 45. Two blocks 82 joinable as mirror images of each other (being identical or similar to each other) are centrally pierced to receive a screw 84 or other device for fitting to a ceiling S (or equivalent structure) or to receive a component similar to 53 in FIGS. 33, 34 for a suspension cable such as 55, 55A. The blocks 82 have, beside the central holes, corresponding depressions 82A, which, when the two blocks are joined, form a socket to receive and secure a link 45 in the horizontal section. In this way a structure can be fixed or suspended with a few suitably distributed pairs of blocks 82, and in the presence of links 45, also suitably distributed. In this case, the use of the components 51, 55 may be dispensed with.

FIG. 45 shows a type of link 93, similar to 3, but longer than 3. In this way, by using links of the two types 3 and 93 for the connection of the upper and lower (when installed) sections 1B and/or 1C of the components 1, it is possible to form structures which are not straight but curved (FIG. 46) or undulating (FIG. 47) to achieve various aesthetic and functional effects.

FIGS. 48 and 49 show some systems of connection with links 45 and with points of connection to an electrical power distribution installation, to provide a power supply to the lighting units.

It is to be understood that the drawing shows only an example provided solely as a practical demonstration of the invention, and that this invention may be varied in its forms and dispositions without departure from the scope of the guiding concept of the invention. The presence of any reference numbers in the enclosed claims has the purpose of facilitating the reading of the claims with reference to the description and to the drawing, and does not limit the scope of protection represented by the claims.

I claim:

1. A sectional network structure comprising in combination the following: a plurality of lattice elements (1) extending in substantially parallel relation such that adjacent lattice elements converge and diverge to define said sectional network structure longitudinal connecting means (1B) together with partial longitudinal connecting means (1C) for joining successive lattice elements (1) in alignment with each other; links (3) for providing connection between said longitudinal connecting means (1B and 1C) for successive lattice elements (1); said links (3) being electrically insulated; means (5 and 7) for providing a mechanical connection between successive lattice elements (1); means (24 and 26) for providing mechanical and electrical connection between successive lattice elements such that a line of successive lattice elements (1) provides a low-voltage current conductor capable of being combined with another conductor formed by a contiguous line of successively abutted lattice elements (1), and said sectional network structure including adapters (61 and 71) adapted to be fitted to said longitudinal connecting means (1B and 1C) for providing lighting and adapted to be combined with said sectional network structure, said adapters (61 and 71) having take-off contacts (67A and 79A) for supplying lighting.

2. The sectional network structure as in claim 1, wherein jaw-type clamps (41) are provided for locking onto lattice elements (1) to provide electrical power supply or transverse electrical connections.

3. The sectional network structure of claim 1, wherein each of said lattice elements (1) comprises an upper and a lower section; and each means for mechanical connection comprises a body (5) and a plate (7) for use as terminals for a terminal cross means (17) for providing connection between ends of said upper section (13) and said lower section (11) of adjacent lattice elements, and wherein said body (5) and said plate (7) are joinable by employing snap fit means including a bolt (22) and a nut (24) as means which pass through said body and said plate (5 and 7) and thus provide a mechanical joint.

4. The sectional network structure as in claims 1 or 2, wherein each of the means for providing mechanical and electrical connection comprises a U-shaped section (24) adapted for supporting therein an adjoining terminal cross means (17) of successive lattice elements (1), said connection including a bar (24) adapted to be tightened by means of a screw against said U-shaped section (24).

5. The network structure as in claim 1, wherein a clamp (51) is provided for locking by fastening means successive sectional network sections (13), including said longitudinal connecting means (1B and 1C) of said plurality of lattice elements (1), said clamp means being adapted to enable said plurality of lattice elements to be suspended.

6. The sectional network structure as in claim 3, wherein transverse electrical connections between adjacent lattice elements are provided by means of rigid rods (43 and 45) in the form of links.

7. The sectional network structure as in claim 6, comprising a pair of blocks (82) adapted to secure each of said link (45), said sectional blocks being connectable to a ceiling for suspending said network structure.

8. The sectional network structure as in claim 1, comprising links (3 and 93) of at least two different sizes for the purpose of providing non-planar configurations of said sectional network structure.

* * * * *